US009394753B2

(12) United States Patent
Hurtado

(10) Patent No.: US 9,394,753 B2
(45) Date of Patent: Jul. 19, 2016

(54) SYSTEM AND METHODOLOGY FOR LOCATING A DEFLECTOR

(71) Applicant: Schlumberger Technology Corporation, Sugar Land, TX (US)

(72) Inventor: José F. Hurtado, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 324 days.

(21) Appl. No.: 13/967,787

(22) Filed: Aug. 15, 2013

(65) Prior Publication Data

US 2015/0047840 A1 Feb. 19, 2015

(51) Int. Cl.

| | |
|---|---|
| ***E21B 23/02*** | (2006.01) |
| ***E21B 23/01*** | (2006.01) |
| ***E21B 23/12*** | (2006.01) |
| ***E21B 41/00*** | (2006.01) |
| ***E21B 7/06*** | (2006.01) |

(52) U.S. Cl.

CPC ..... *E21B 23/01* (2013.01); *E21B 7/061* (2013.01); *E21B 23/002* (2013.01); *E21B 41/0035* (2013.01)

(58) Field of Classification Search

CPC ..... E21B 7/061; E21B 23/002; E21B 23/14; E21B 41/0035

See application file for complete search history.

(56) References Cited

U.S. PATENT DOCUMENTS

| | | | | |
|---|---|---|---|---|
| 5,137,086 | A * | 8/1992 | Stokley | E21B 49/082 166/191 |
| 6,012,527 | A | 1/2000 | Nitis et al. | |
| 6,056,059 | A | 5/2000 | Ohmer | |
| 6,315,054 | B1 | 11/2001 | Brunet | |
| 6,349,768 | B1 | 2/2002 | Leising | |
| 6,474,415 | B1 | 11/2002 | Ohmer | |
| 6,554,062 | B1 * | 4/2003 | Dewey | E21B 7/061 166/117.6 |
| 7,284,607 | B2 | 10/2007 | Araque et al. | |
| 2005/0230151 | A1 | 10/2005 | McGarian et al. | |
| 2008/0115940 | A1 | 5/2008 | Brunet et al. | |

(Continued)

FOREIGN PATENT DOCUMENTS

| | | |
|---|---|---|
| WO | WO2000063528 | 10/2000 |
| WO | 0125587 A1 | 4/2001 |

(Continued)

OTHER PUBLICATIONS

International Search Report and Written Opinion issued in PCT/US2014/050493 on Nov. 28, 2014, 13 pages.

*Primary Examiner* — David Andrews
(74) *Attorney, Agent, or Firm* — Michael Stonebrook

(57) ABSTRACT

A technique facilitates deflecting a tubing string into a desired branch of a surrounding tubular structure. A deflector assembly is provided with a deflector tube, an orienting member, and a latching feature, such as latch dogs which are circumferentially disposed on the deflector tube in an asymmetrical pattern. The deflector assembly may be moved within the outer tubular structure, e.g. wellbore tubing, to a desired junction. The deflector tube and the latching feature are then oriented in an alignment sleeve of the surrounding tubular structure by moving the orienting member along a profile within the outer tubular structure. The latching feature is able to securely latch at the selected junction. The latching feature may use a pattern of latch dogs which matches a corresponding asymmetrical pattern of latch openings in the alignment sleeve.

19 Claims, 10 Drawing Sheets

(56) References Cited

U.S. PATENT DOCUMENTS

| | | | |
|---|---|---|---|
| 2010/0059279 | A1 | 3/2010 | Saylor |
| 2010/0170677 | A1 | 7/2010 | Ingraham |
| 2010/0224414 | A1 | 9/2010 | Radford et al. |

FOREIGN PATENT DOCUMENTS

| | | |
|---|---|---|
| WO | WO2011034547 | 3/2011 |
| WO | WO2012061096 | 5/2012 |
| WO | WO2013019809 | 2/2013 |
| WO | WO2013022691 | 2/2013 |

* cited by examiner

SYSTEM AND METHODOLOGY FOR LOCATING A DEFLECTOR

BACKGROUND

The use of multilateral wells has become common in facilitating the production of desired fluids, e.g. oil and gas. Well construction and/or servicing operations may be performed in a main wellbore and in lateral wellbores extending from the main wellbore. When an operation is to be performed in the main wellbore or in one of the lateral wellbores, a well string is directed to the selected wellbore. However, difficulties can arise in determining and selecting the desired wellbore particularly when the spacing between lateral wellbores is relatively short.

SUMMARY

In general, a methodology and system are provided for deflecting a tubing string, e.g. a well string, into a desired branch of a surrounding tubular structure, e.g. a tubing deployed in a main wellbore or lateral wellbore. A deflector assembly is provided with a deflector tube, an orienting member, and a latching feature, e.g. latch dogs which are circumferentially disposed on the deflector tube in an asymmetrical pattern. The deflector assembly may be moved within the surrounding tubular structure to a desired junction. The deflector tube and the latching feature are then oriented in an alignment sleeve of the surrounding tubular structure by moving the orienting member along a profile within the surrounding tubular structure. The latching feature, e.g. latch dogs, is able to securely latch with a corresponding latch mechanism in the alignment sleeve positioned at the selected junction. For example, the latch dogs may securely latch with corresponding latch openings when the pattern of latch dogs matches a corresponding asymmetrical pattern of the latch openings in the alignment sleeve.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
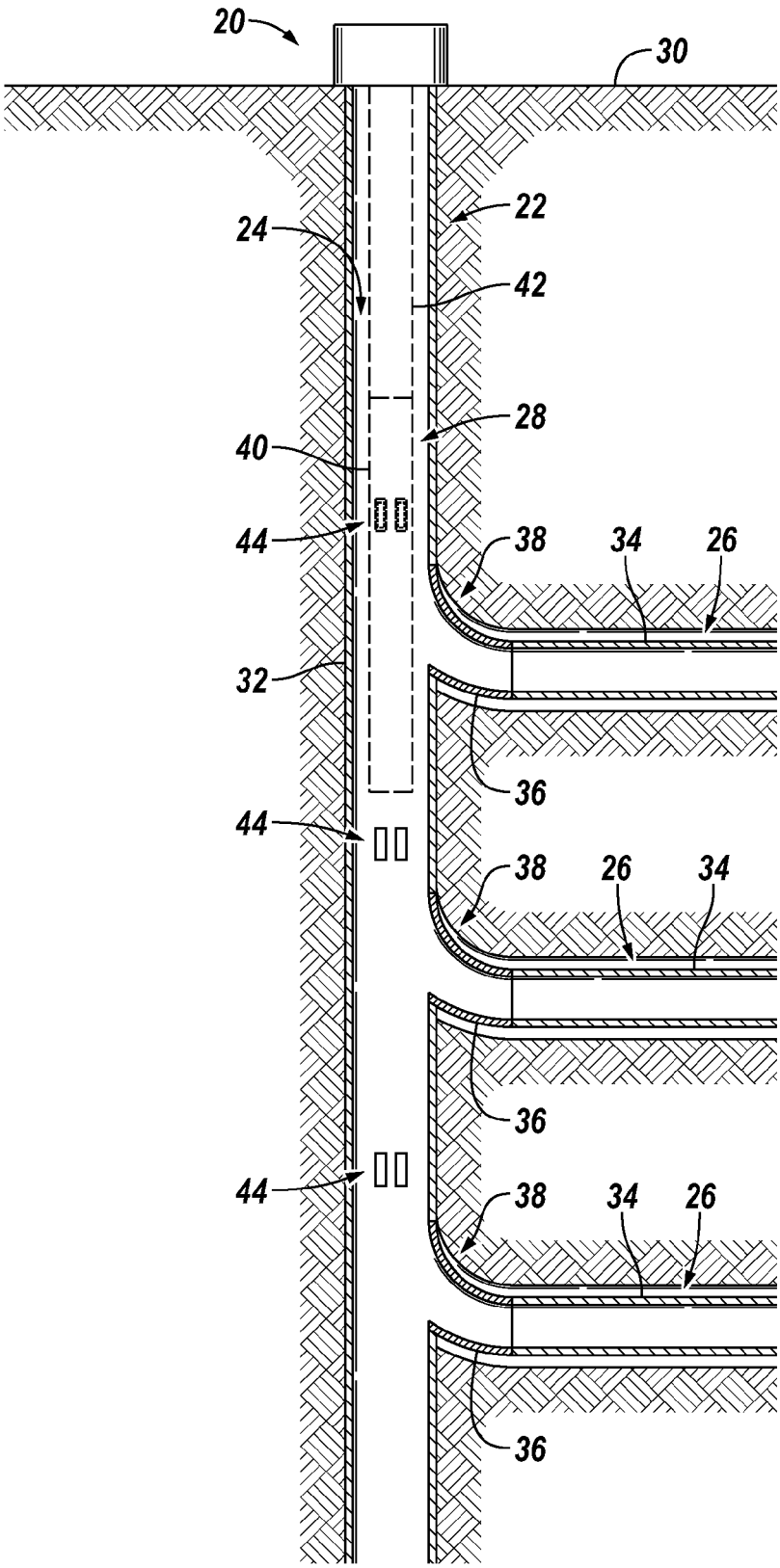
FIG. 1 is an illustration of an example of a well system having a main wellbore joined by a plurality of lateral wellbores, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate deflection of a tubing string, e.g. a well string, into a desired branch of a surrounding tubular structure. For example, the technique can be used to deflect a service string, e.g. an intervention string carrying an intervention tool, or other well string into a selected main wellbore or lateral wellbore in a multilateral well. A deflector assembly is deployed into the surrounding tubular structure. In well applications, for example, the deflector assembly is deployed downhole to a specific junction location.

According to an embodiment, the deflector assembly is provided with a deflector tube, an orienting member, and a latching feature, e.g. latch dogs which are circumferentially disposed on the deflector tube in an asymmetrical pattern. The deflector assembly may be moved within the surrounding wellbore tubular or other surrounding tubular structure to the desired junction. In this example, the deflector tube and the latch dogs are then oriented in an alignment sleeve of the surrounding tubular structure by moving the orienting member along a profile within the outer tubular structure. The latch dogs are able to securely latch at the selected junction when the pattern of latch dogs matches a corresponding latching mechanism in the surrounding tubular structure, e.g. a corresponding asymmetrical pattern of latch openings in the alignment sleeve.

In well applications, the deflector assembly is run downhole from the surface to a specific target junction between a main wellbore and a lateral wellbore. The deflector assembly is then oriented and latched at the specific target junction to deflect a subsequent well string either into the lateral wellbore or into continued movement along the main wellbore. The latching mechanism enables testing of the latch to verify that the deflector assembly is latched securely at the selected target junction location and in the desired orientation.

In an embodiment of the overall system, latch dogs are installed on the deflector assembly and used to both latch and locate the deflector assembly in a corresponding latching mechanism. By way of example, the latching mechanism may comprise latch slots machined or otherwise formed in an alignment sleeve of the surrounding tubular structure. The size and/or configuration of the latching mechanism is different at each target junction. Thus, the size and configuration of the latch dogs may be selected to ensure latching of a given deflector assembly at the desired junction, e.g. at the desired lateral wellbore junction. The arrangement of the latch dogs and the corresponding latching mechanism, e.g. latch slots, also may be selected to ensure a desired orientation of the deflector assembly. A predetermined, axial force directed along the deflector assembly may be used to verify proper latching. For example, the latch dogs and latching mechanism may be designed such that a pull force above a predetermined level is indicative of proper latching in the desired orientation.

Referring generally to FIG. 1, an embodiment of a well system 20 is illustrated as comprising a multilateral well 22 having a main wellbore 24 and a plurality of lateral wellbores 26. A tubular structure 28 extends from a surface location 30 and may comprise a variety of tubular structures. In a multilateral well application, for example, the tubular structure 28 may comprise a main wellbore casing 32 joined with a lateral tubing 34, e.g. liner, disposed in each lateral wellbore 26. In this type of well application, the lateral tubing structures 34 may be joined with the main wellbore casing 32 or other main wellbore tubing by a suitable tubing junction 36 at each wellbore junction 38 between the main wellbore 24 and a given lateral wellbore 26.

As further illustrated in FIG. 1, a deflector assembly 40 may be deployed through tubular structure 28. In a well application, the deflector assembly 40 is deployed downhole through main wellbore casing 32 of tubular structure 28 from surface location 30 and to a desired tubing junction 36. The deflector assembly 40 may be deployed downhole by a conveyance 42, such as coiled tubing or another type of suitable conveyance. The deflector assembly 40 is designed to orient and latch at a specific latching mechanism 44. In the example illustrated, each latching mechanism 44 has a different size and/or configuration to ensure latching of the deflector assembly 40 at the desired tubing junction 36. By way of example, the latching mechanisms 44 may comprise latch slots in which the latch slots at the most distant lateral wellbore 26 (measured from the surface 30) are the longest and each sequential lateral wellbore is associated with a latching mechanism 44 having progressively shorter latch slots. By appropriately designing deflector assembly 40, proper latching can be achieved at the desired, predetermined tubing junction 36.

Figure 2:
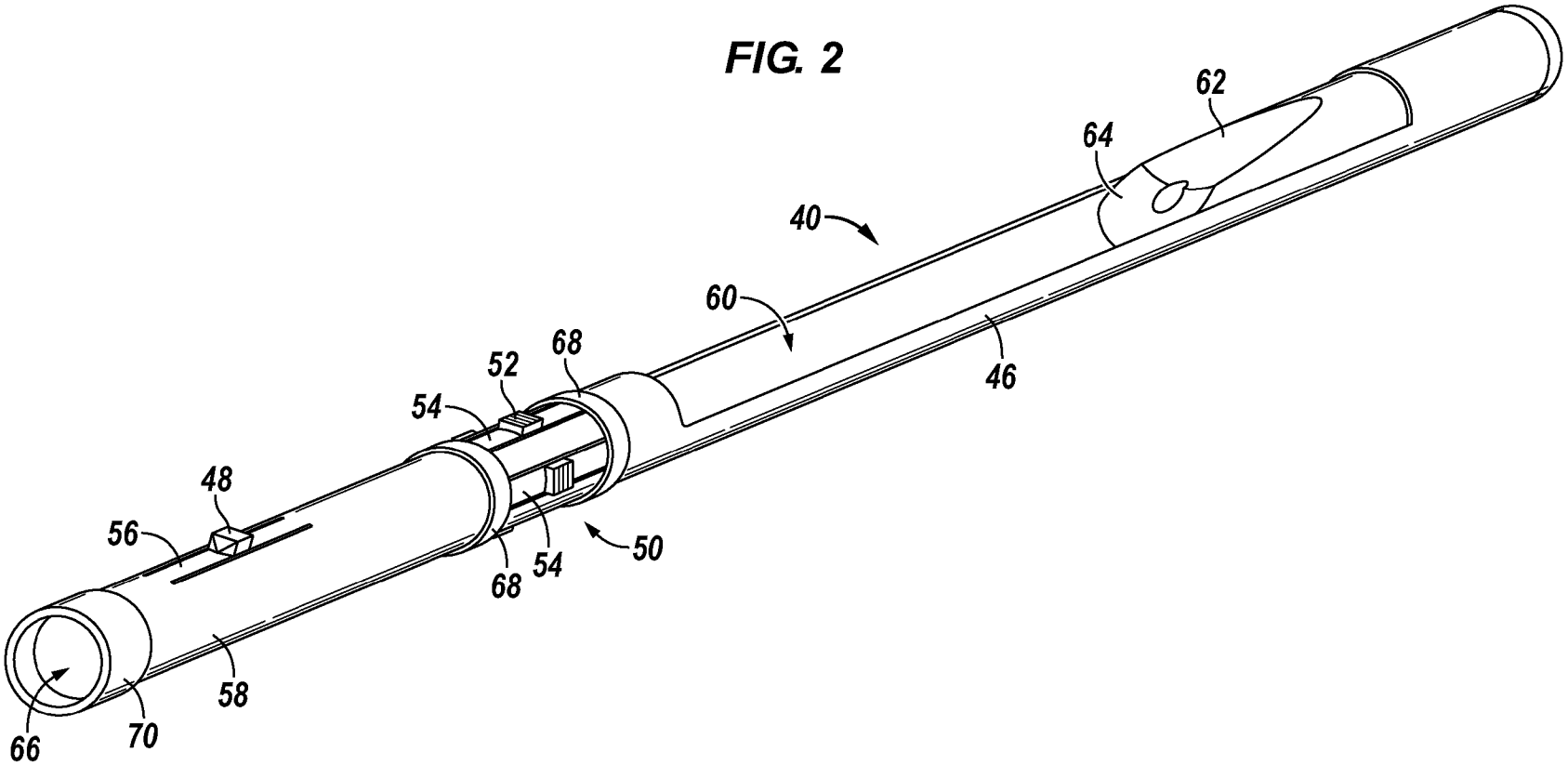
FIG. 2 is an illustration of an example of a deflector assembly, according to an embodiment of the disclosure.

Referring generally to FIG. 2, an embodiment of deflector assembly 40 is illustrated. In this embodiment, deflector assembly 40 comprises a deflector tube 46, an orienting member 48, and a latching feature 50. By way of example, latching feature 50 comprises a plurality of latch dogs 52 circumferentially disposed about deflector tube 46 in an asymmetrical pattern. In other words, the circumferential distance between at least some of the sequential latch dogs 52 differs from the circumferential distance between other sequential latch dogs 52. The latch dogs 52 may be mounted on spring members 54 which resist movement of the latch dogs 52 in a radial direction and serve to bias the latch dogs 52 in a radially outward direction when flexed inwardly. In at least some embodiments, orienting member 48 is similarly spring biased via an orienting member spring 56. Although a variety of spring members 54 and springs 56 may be utilized, the illustrated example employs beam type springs in which spring members 54 and spring 56 may be constructed as flexible, circumferentially curved beams formed in the deflector tube 46. One method of forming the beam spring members 54 and beam springs 56 is to machine or otherwise form radial slots through a sidewall 58 of deflector tube 46 on both sides of each latch dog 52 and/or orienting member 48. Examples of other types of springs 54, 56 comprise wave springs, Belleville springs, helical springs, and other suitable spring types.

As further illustrated in FIG. 2, deflector assembly 40 also may comprise a deflector tube window 60 formed through the sidewall 58 of deflector tube 46. A deflector slide 62 may be mounted within deflector tube 46 such that an angled slide surface 64 of deflector slide 62 is oriented toward deflector tube window 60. In a downhole application, for example, the deflector tube window 60 and the slide surface 64 may be oriented toward a selected lateral wellbore 26 to deflect a tubing string, e.g. a well service string, from an interior 66 of deflector tube 46 and along slide surface 64 until the tubing string is moved out through window 60 and into the lateral wellbore tubing 34 of the selected lateral wellbore 26. In some applications, deflector assembly 40 also may comprise a centralizer 68 mounted proximate latch dogs 52 and spring members 54. In the illustrated example, a plurality of centralizers 68 is employed with at least one centralizer 68 located at each longitudinal end of the latching feature 50 to ensure centralization and secure latching of latch dogs 52. The deflector assembly 40 also may comprise an adapter 70 designed to connect the deflector assembly 40 with the corresponding conveyance 42, e.g. coiled tubing.

Figure 3:
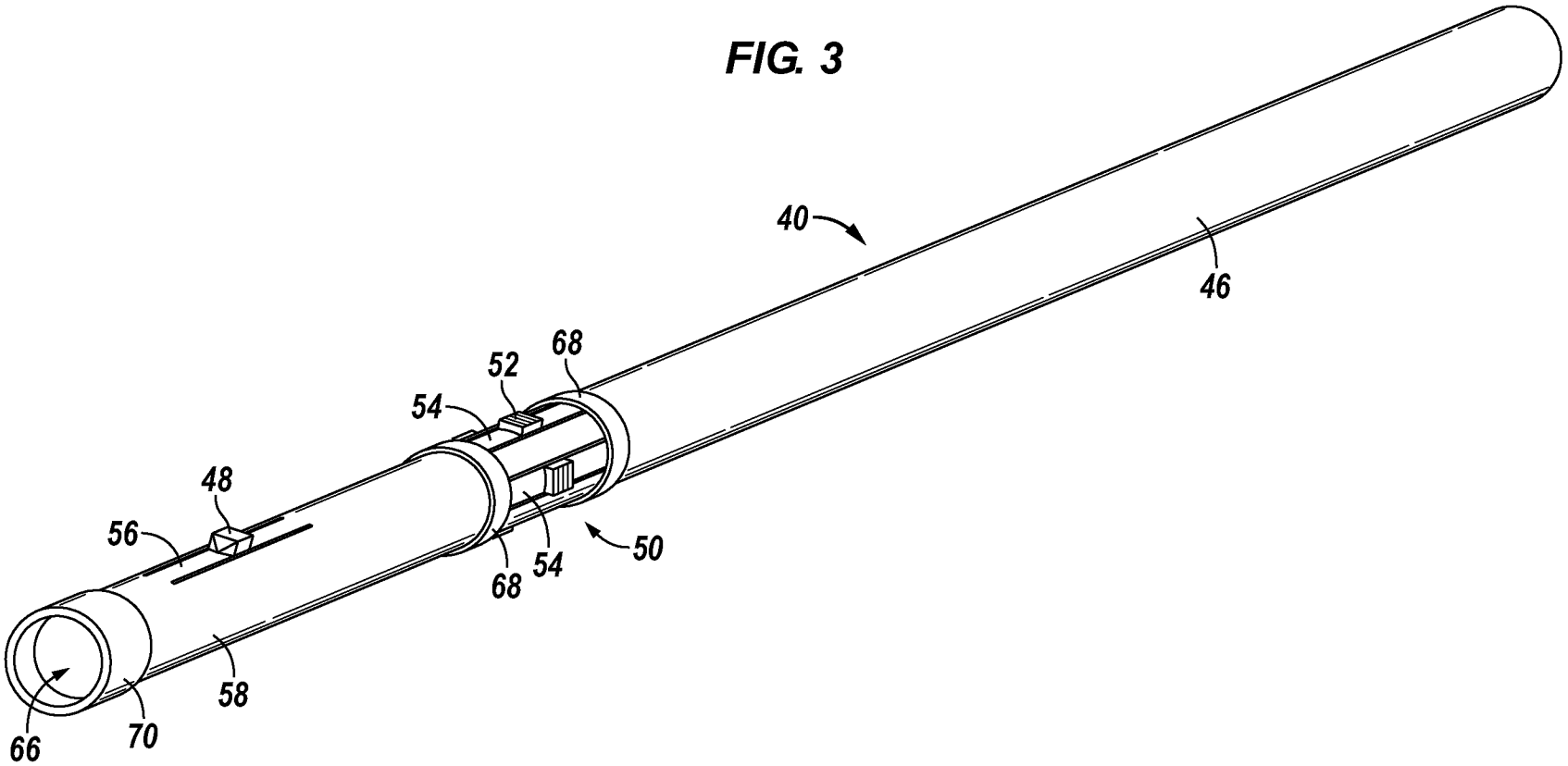
FIG. 3 is an illustration of another example of a deflector assembly, according to another embodiment of the disclosure.

Referring generally to FIG. 3, another embodiment of deflector assembly 40 is illustrated. In this embodiment, many of the features are the same as those described above with respect to the embodiment illustrated in FIG. 2. However, the embodiment illustrated in FIG. 3 may be employed as a main wellbore deflector assembly to deflect a tubing string, e.g. a well service string, into the main wellbore casing 32 at a given tubing junction 36. As illustrated, the deflector tube 46 has a solid sidewall 58 (without deflector tube window 60) and interior 66 extends through the entire deflector tube 46 to ensure the tubing string bypasses the subject lateral wellbore 26 and remains in the main wellbore 24.

Figure 4:
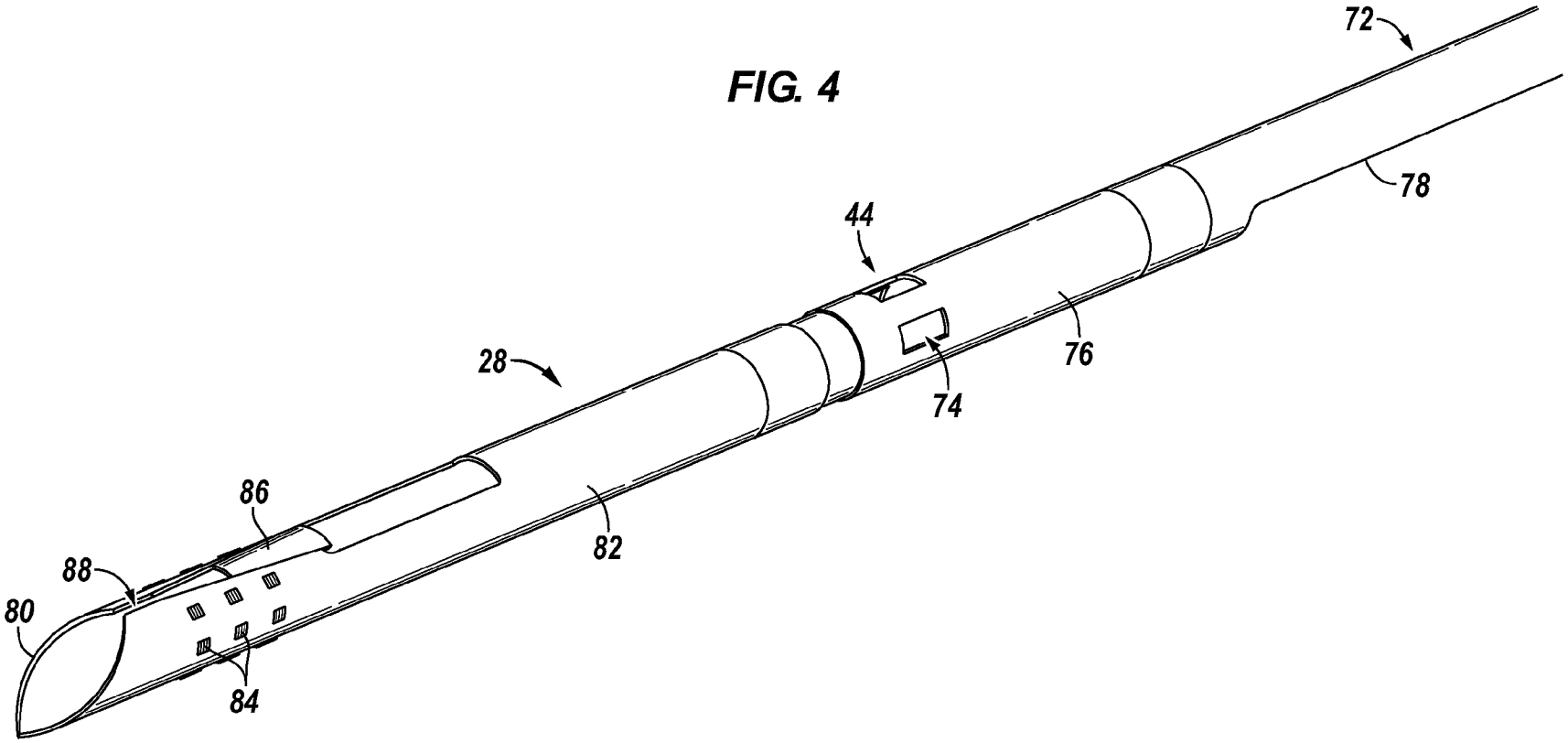
FIG. 4 is an illustration of an example of a tubular structure designed to receive the deflector assembly, according to an embodiment of the disclosure.
Figure 5:
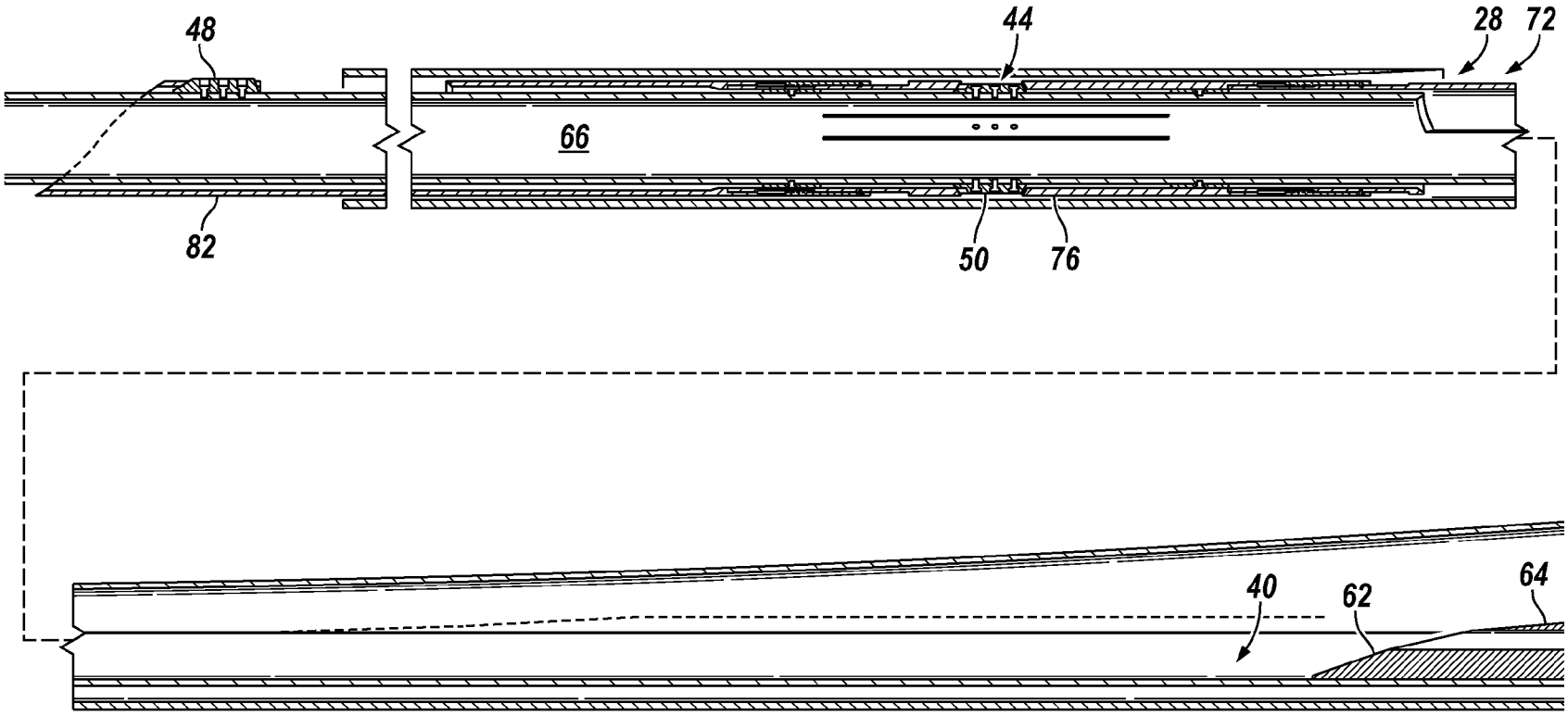
FIG. 5 is a cross-sectional view of an example of a deflector assembly deployed in a surrounding tubular structure located in a wellbore at a junction between a main wellbore and a lateral wellbore, according to an embodiment of the disclosure.

In FIG. 4, a section of the surrounding tubular structure 28 is illustrated as including latching mechanism 44. The latching mechanism 44 is designed to receive and latch with latching feature 50, e.g. latch dogs 52, of the deflector assembly 40, as further illustrated in FIG. 5. By way of example, the section of surrounding tubular structure 28 may comprise a lateral tube assembly 72 used to couple the main wellbore casing 32 with the lateral wellbore tubing 34 at each tubing junction 36. However, the illustrated section of tubular structure 28 may comprise a variety of other types of tubular structures designed to receive deflector assembly 40 and dependent on the specific type of well application or other application in which deflector assembly 40 is utilized.

In the example illustrated, the latching mechanism 44 comprises a plurality of latch openings 74, e.g. slots, sized to receive latch dogs 52. As discussed above, the size of latch openings 74 may be unique to each tubing junction 36 so as to ensure the desired latch dogs 52 of the desired deflector assembly 40 latch at the preselected tubing junction 36. The latch openings 74 may be located in an alignment sleeve 76 which is part of the overall tubular structure 28. The alignment sleeve 76 may be designed so latch openings 74 are circumferentially spaced in an asymmetrical pattern which matches the circumferential, asymmetrical pattern of the latch dogs 52. In this manner, alignment sleeve 76 ensures proper latching of the deflector assembly 40 at the appropriate angular position with respect to the alignment sleeve 76 and tubular structure 28. The asymmetrical, circumferential pattern may be used to ensure proper orientation of deflector tube window 60 with a corresponding space or opening 78 in the tubular structure 28 so as to provide access to the desired lateral wellbore tubing 34.

Figure 6:
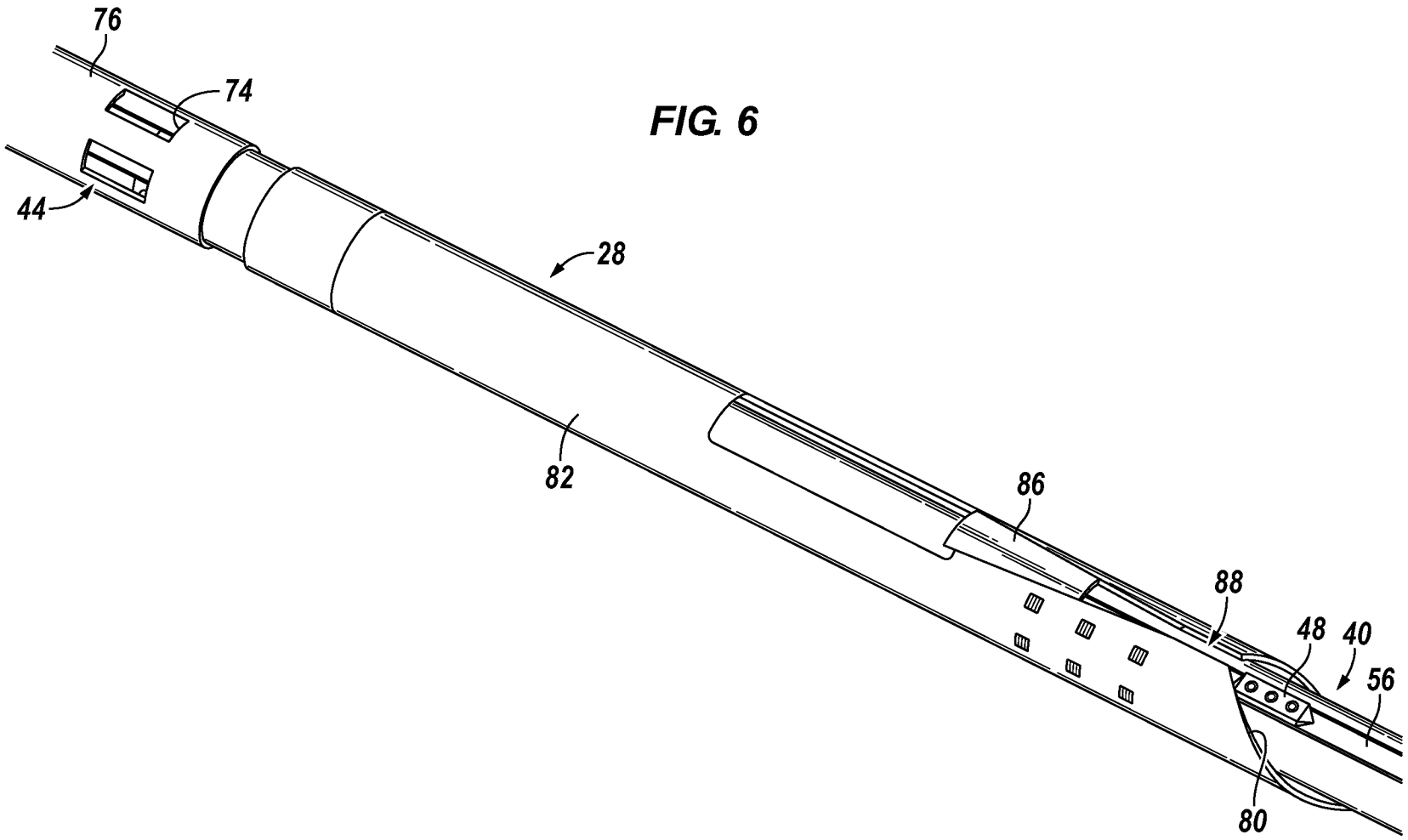
FIG. 6 is an illustration of the deflector assembly being rotated relative to the tubular structure by an alignment member, according to an embodiment of the disclosure.
Figure 7:
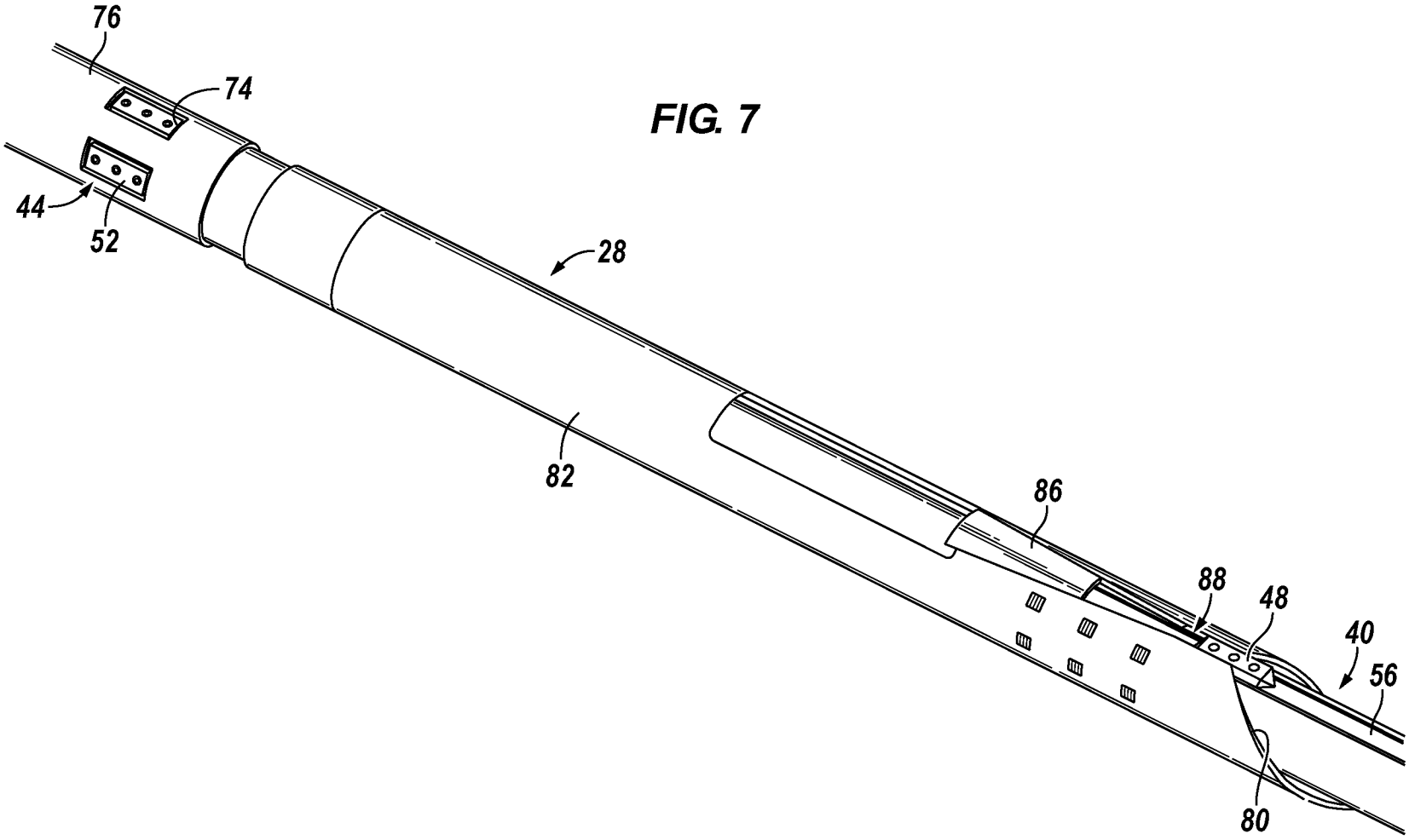
FIG. 7 is an illustration similar to that of FIG. 6 but showing the deflector assembly aligned with the outer tubular structure in a manner which enables latching of deflector assembly latch dogs with the corresponding latch openings formed in the tubular structure, according to an embodiment of the disclosure.

With additional reference to FIGS. 6 and 7, rotational orientation of the deflector assembly 40 with respect to the tubular structure 28 may be achieved by using orienting member 48 in cooperation with a profile 80 in tubular structure 28. By way of example, the profile 80 may be formed as a helix of a muleshoe which guides the orienting member 48 and rotates the deflector assembly 40 with respect to the outer tubular structure 28, as illustrated in FIG. 6. If tubular structure 28 comprises lateral tube assembly 72, the profile 80 may be formed in a lateral locating insert 82 coupled with, for example, alignment sleeve 76 on an uphole end of alignment sleeve 76. In this latter embodiment, the lateral locating insert 82 may be secured with main wellbore casing 32 via teeth 84 expanded into an interior surface of the main wellbore casing 32 by a lateral locating insert wedge 86.

Regardless of the form of the tubular structure containing profile 80, the profile 80 may be used to cause relative rotation of the deflector assembly 40 with respect to the tubular structure 28 as the deflector assembly 40 is moved longitudinally with respect to the tubular structure 28. Once the deflector assembly 40 is rotationally oriented, the orienting member 48 is allowed to move along a longitudinal slot 88, as illustrated in FIG. 7. The width of orienting member 48 may be designed to properly fit within longitudinal slot 88. The side surfaces of orienting member 48 may have serrations or other features oriented to bite or grab onto the flat, adjacent sidewall of the deflector tube 46 if spring 56 is deflected inwardly while under side loading. For example, the serrations may be positioned close to the deflector tube wall adjacent spring 56 so any side loading on orienting member 48 during orientation causes the serrations to be pushed against and to bite into the adjacent deflector tube wall. The serrations keep orienting member 48 from being pushed inwardly prematurely while still orienting. Once the orientation is completed, the orientation member 48 can be pushed radially inwardly by, for example, an angled nose feature. The nose angle may be designed so that the force acting on the nose angle does not cause sideways movement of the serrations into the adjacent deflector tube wall. (It should be noted that orienting member 48 also may be designed so that it runs radially preloaded against the internal surface of casing 32. The spring preloading may be accomplished by designing the height of orienting member 48 so as to press the orienting member 48 slightly inward in a radial direction due to contact with the internal surface of casing 32. The radial preloading creates an outward bias.) Orienting member 48 moves along longitudinal slot 88 in tubular structure 28 until the deflector assembly 40 is properly located in the outer tubular structure 28 (see FIG. 5). For example, the deflector tube window 60 may be properly oriented and aligned to provide access to the lateral wellbore tubing 34. At this stage, the latch dogs 52 are able to radially expand into the corresponding latch openings 74 via spring members 54, thus latching the deflector assembly 40 in the surrounding tubular structure 28 at the desired orientation and location. To verify that each latch dog 52 has engaged its corresponding latch opening 74, a tensile pull force may be applied to the deflector assembly 40. If the latch dogs 52 remain latched with the corresponding latch opening 74 to a predetermined tensile load, proper latching is verified.

Figure 8:
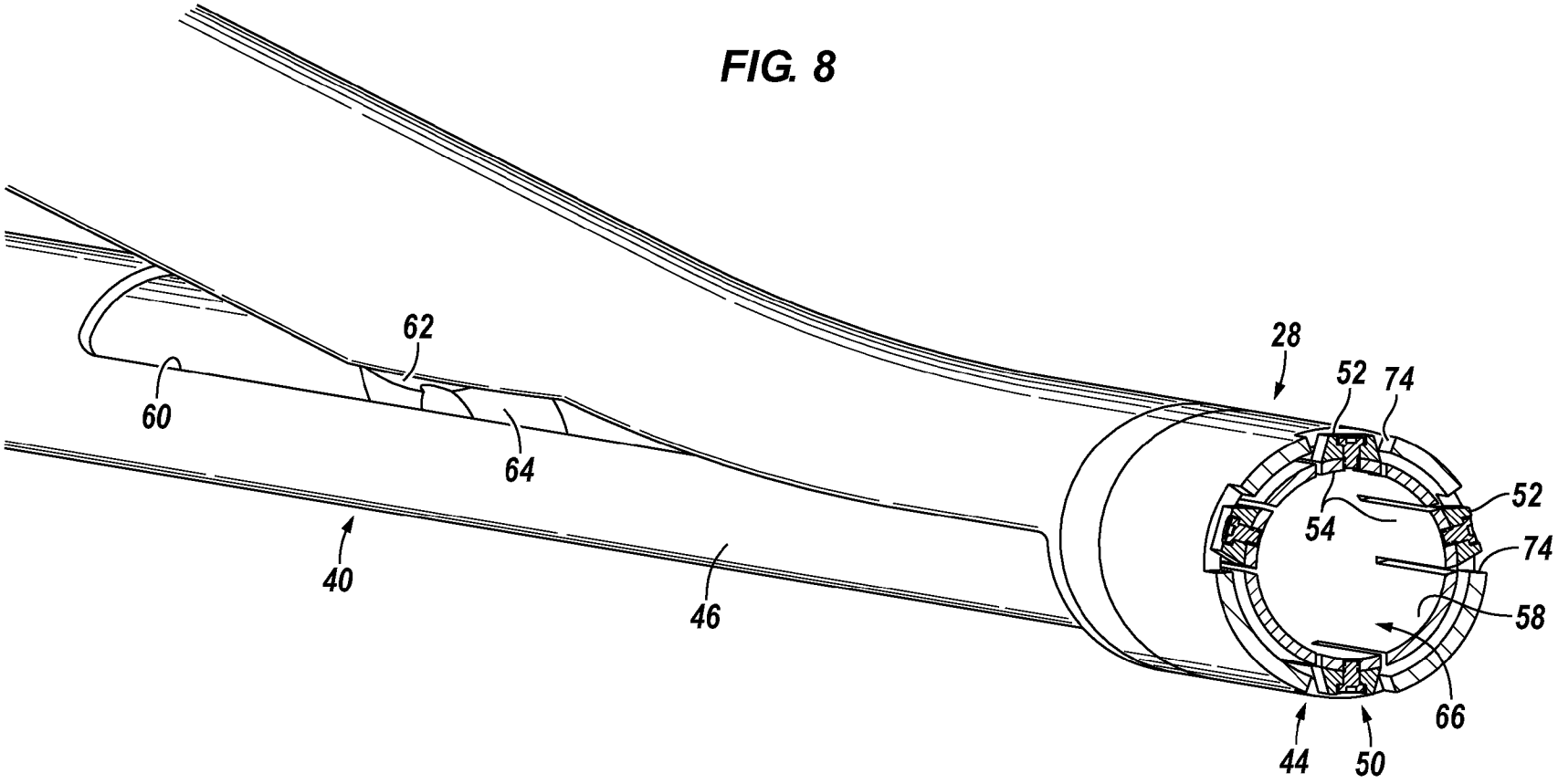
FIG. 8 is a cross-sectional view illustrating the latch dogs latched with the corresponding latch openings in an asymmetrical, circumferential pattern, according to an embodiment of the disclosure.

In FIG. 8, for example, an embodiment is illustrated in which latching feature 50 comprises four latch dogs 52 that have expanded radially and latched into four corresponding latch openings 74. As illustrated, the four latch dogs 52 and the four corresponding latch openings 74 have been arranged circumferentially in a pattern which does not have even spacing between latch dogs 52 (and between latch openings 74) in a circumferential direction. In other words, the latch dogs 52 and the latch openings 74 have been arranged in an asymmetrical pattern so that receipt of the four latch dogs 52 by the four corresponding latch opening 74 involves properly orienting the deflector assembly 40 in a single, predetermined angular orientation.

Figure 9:
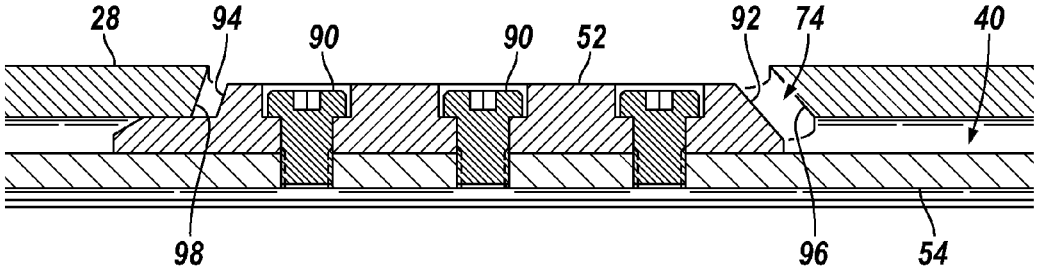
FIG. 9 is a cross-sectional illustration of a latch dog disposed in a corresponding latch opening, according to an embodiment of the disclosure.
Figure 10:
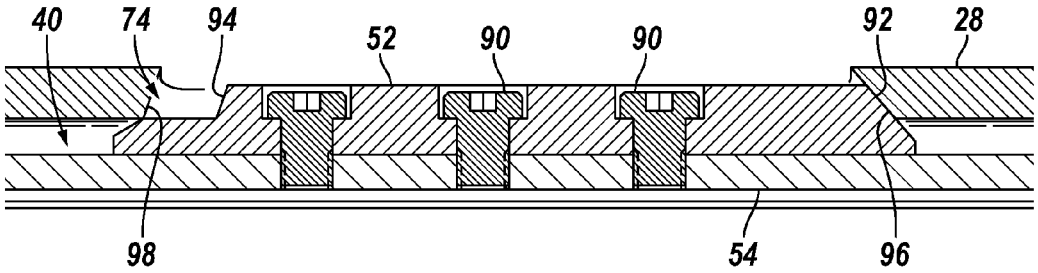
FIG. 10 is an illustration similar to that of FIG. 9 but showing a downhole face abutting a corresponding surface of the latch opening at a predetermined angle to control a snap-in force, according to an embodiment of the disclosure.

Referring generally to FIGS. 9 and 10, an example of one of the latch dogs 52 is illustrated as mounted on its corresponding spring member 54 and received in the corresponding latch opening 74 of alignment sleeve 76. In this example, the latch dog 52 is attached to spring member 54 by a fastener 90, such as a plurality of screws. Each latch dog 52 also may be constructed with a downhole face 92 and an uphole face 94. The downhole face 92 is oriented for engagement with a corresponding face 96 disposed along the latch opening 74. Similarly, the uphole face 94 is oriented for engagement with a corresponding face 98 also disposed along the latch opening 74 but on an opposing side of the latch opening 74 from face 96. Downhole face 92 (as well as corresponding face 96) is angled at a predetermined angle to control the snap-in force used to snap the latch dog 52 out of latch opening 74 as the deflector assembly 40 is moved in a downhole direction. Similarly, uphole face 94 (as well as corresponding face 98) is angled at a predetermined angle to control the snap-out force used to snap the latch dog 52 out of latch opening 74 as the deflector assembly 40 is moved in an uphole direction. In some applications, the latch dogs 52 may have side faces oriented at selected angles. In this type of embodiment, the side angles can be used to control a torque employed in unlatching dogs 52 from latch openings 74.

As deflector assembly 40 is moved farther downhole with respect to the surrounding tubular structure 28, downhole face 92 abuts against corresponding face 96, as illustrated in FIG. 10. To continue the downhole movement, sufficient force is applied to the deflector assembly 40 in an axial direction to cause corresponding face 96 to effectively force latch dog 52 radially inward. The latch dog 52 is moved radially inward, via the interaction of angled faces 92 and 96, against the spring bias of spring member 54 until the latch dog 52 can slide beneath the sidewall forming tubular structure 28. The latch dogs 52 move along the interior of tubular structure 28 after having been pushed radially inward so that engagement with latch openings 74 is lost. Similarly, movement of the deflector assembly 40 in an uphole direction with respect to tubular structure 28 involves applying a sufficient pull force to the deflector assembly 40 in an axial direction to cause corresponding face 98 to effectively force latch dog 52 radially inward against the spring bias of spring member 54 until the latch dog 52 can slide beneath the sidewall forming tubular structure 28.

The angle of downhole face 92 and corresponding face 96 as well as the angle of uphole face 94 and corresponding face 98 may be selected to control the snap-in force and the snap-out force, respectively. The total snap-in force or snap-out force equals the snap-in force or snap-out force for each latch dog 52 times the total number of latch dogs 52, e.g. four latch dogs 52. In some applications, the snap-out force may be used to verify that each of the latch dogs 52 has been received in its corresponding latch opening 74. For example, if the snap-out force for each latch dog 52 is a 2500 lb pull force and the deflector assembly 40 comprises four latch dogs 52, the overall snap-out force equals a 10,000 lb pull force. If a pull force is applied and the deflector assembly 40 snaps out of latch opening 74 with less than a 10,000 lb pull force, the operator understands that at least one latch dog 52 has not been latched with its corresponding latch opening 74. Such a scenario may involve further rotational orientation of the deflector assembly 40 with respect to the tubular structure 28 to ensure that the four latch dogs 52 latch with the four corresponding latch openings 74. The downhole face 92 and the uphole face 94 may be angled at a variety of angles to create desired, predetermined snap-in and snap-out forces depending on the parameters of a given operation.

It should be noted that orienting member 48 may have a similar downhole face 92, uphole face 94 and/or side face angles. The downhole face 92 and the uphole face 94 of orienting member 48 may be angled to similarly facilitate flexing of orienting member spring 56 inwardly as orienting member 48 is forced under a sidewall of the surrounding tubular structure 28. In some applications, orienting member 48 has a side surface with a special profile designed to contact and slide against profile 80 of, for example, a helical muleshoe forming part of the tubular structure 28. The special profile of the side surface may be in the form of a retention face angled at a bias angle to reduce the tendency for the orienting member 48 to move radially inward while the orienting member 48 is forced to slide along profile 80.

Figure 11:
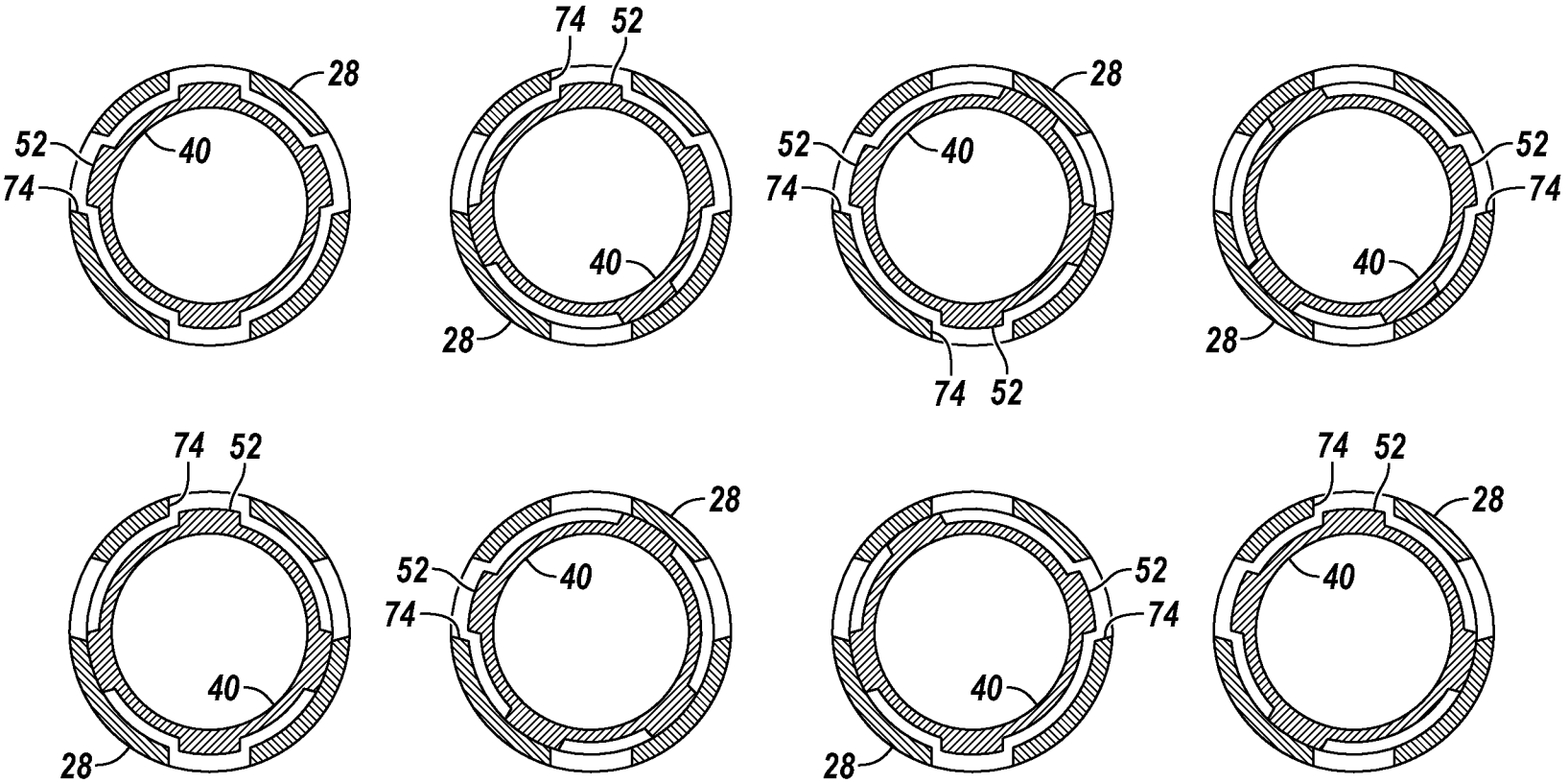
FIG. 11 is a schematic illustration showing different potential circumferential orientations of the deflector assembly with respect to the outer tubular structure and the number of latch dogs which latch in corresponding latch openings at those various orientations, according to an embodiment of the disclosure.

Referring generally to the schematic illustration of FIG. 11, examples are provided of possible angular positions of deflector assembly 40 with respect to the surrounding tubular structure 28. Because of the asymmetrical, circumferential pattern of the latch dogs 52 and the corresponding latch openings 74 different relative angular positions of the deflector assembly 40 with respect to the surrounding tubular structure 28 can lead to differing numbers of latchings between the latch dogs 52 and the corresponding latch openings 74. In the embodiment of FIG. 11, an example is provided of a deflector assembly with four latch dogs 52 arranged in a circumferential, asymmetrical pattern and four corresponding latch openings 74 arranged in a corresponding circumferential, asymmetrical pattern. If the deflector assembly 40 is properly oriented by orienting member 48, then the four latch dogs 52 latch with the four corresponding latch openings 74, as indicated by the upper left diagram in FIG. 11.

However, other angular orientations of deflector assembly 40 with respect to the surrounding tubular structure 28 can lead to various combinations of individual latch dogs 52 or pairs of latch dogs 52 latching, as indicated by the remaining diagrams in FIG. 11. Proper latching of the four latch dogs 52 with the four corresponding latch openings 74 can be verified by applying a predetermined pull force to the deflector assembly. If the latch dogs 52 remain latched upon application of the predetermined pull force, the surface operator knows that the four latch dogs 52 and the four corresponding latch openings 74 have latched. The latching of a lower number of latch dogs 50 would result in release of the latch upon application of a lower pull force than the predetermined pull force.

As described above, the latch dogs 52 and the corresponding latch slots 74 may be designed in different sizes and configurations. For example, latch dogs 52 on different deflector assemblies 40 may have different lengths designed to match the specific lengths of corresponding latch slots 74 at predetermined junctions 36. The latch dogs 52 may be designed with different lengths such that the longer latch dogs 52 latch with the corresponding longer latch openings 74 but bypass the shorter latch openings 74. Additionally, each set of latch dogs 52 and corresponding latch slots 74 can be placed at different circumferential locations relative to the circumferential locations at other sets of latch dogs 52 and corresponding latch slots 74. Different circumferential patterns at each sequential tubing junction 36, for example, can be used to create more latch dog/latch opening combinations. In some applications, both different lengths and different circumferential patterns can be used in combination.

In one operational example, the longest corresponding latch slots 74 are placed proximate the tubing junction 36 located farthest downhole. The deflector assembly 40 with the longest latch dogs 52 would bypass the shorter latch slots 74 until latching with the corresponding longest latch openings 74 at the tubing junction 36 located farthest downhole. Each sequential tubing junction 36 (moving in an uphole direction) would have a progressively shorter set of latch openings 74 for latching with latch dogs 52 of corresponding length. In this manner, specific deflector assemblies 40 may be latched at specific tubing junctions 36 for intervention operations (or other types of operations) in the corresponding lateral wellbore 26. In some applications, certain sets of latch slots 74 may be of comparable length with other sets of latch slots 74.

Various embodiments of deflector assembly 40 and surrounding tubular structure 28 may be employed in many downhole applications and in other types of applications. In a variety of downhole applications, for example, the tubular structure 28 comprises lateral tube assembly 72 which, in turn, may utilize a lateral locating insert to attach and anchor the lateral tube assembly 72 in the main wellbore casing 32. In these types of applications, the lateral tube assembly 72 may include a pre-milled window which aligns with a casing window of the main bore casing 32. However, a variety of other tubular structures 28 may be utilized with deflector assembly 40.

Additionally, the deflector assembly 40 and the surrounding tubular structure 28 may comprise a variety of components depending on the parameters of a given operation. For example, the tubular structure may have a variety of profiles 80, e.g. helical profiles or other suitable profiles, to guide the alignment member 48. The deflector assembly 40 may utilize a variety of configurations for the orienting member 48 and for the latch dogs 52. Similarly, many types of latch dogs spring members 54 and orienting member springs 56 may be employed depending on the types of latch dogs 52 and orienting members 48 employed for a given operation. The spring/spring members may comprise beam springs or other types of springs oriented to provide the desired spring bias. The component materials and configurations also can be adjusted to accommodate the environments and characteristics associated with a given operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for locating a deflector in a wellbore, comprising:

providing a deflector assembly with a deflector tube, an orienting member, and a plurality of spring-loaded latch dogs circumferentially disposed on the deflector tube in an asymmetrical pattern;

moving the deflector assembly downhole through a tubular structure to a specific wellbore junction of a plurality of wellbore junctions along the tubular structure, the tubular structure having an orienting profile and a slot disposed in a sidewall of the tubular structure extending from the orienting profile towards an alignment sleeve, wherein the orienting member engages the orienting profile to rotatably adjust the deflector assembly with respect to the tubular structure;

orienting the plurality of spring-loaded latch dogs with a plurality of latch openings in the alignment sleeve of the tubular structure by moving the orienting member along the slot of the tubular structure;

latching the plurality of spring-loaded latch dogs in the plurality of latch openings; and verifying that each spring-loaded latch dog is received in a corresponding latch opening of the plurality of latch openings by applying a pull force sufficient to indicate a complete latching.

2. The method as recited in claim 1, wherein providing comprises providing the deflector assembly with a deflector slide; and wherein orienting comprises orienting the deflector slide toward a lateral wellbore.

3. The method as recited in claim 1, further comprising applying a pull force to the deflector assembly to determine whether the plurality of spring-loaded latch dogs has properly latched in the plurality of latch openings.

4. The method as recited in claim 3, wherein providing comprises providing four spring-loaded latch dogs.

5. The method as recited in claim 1, wherein providing comprises providing the deflector tube assembly with the deflector tube constructed to direct a passing well string into a main wellbore.

6. The method as recited in claim 1, wherein providing comprises providing the deflector assembly with a centralizer proximate the plurality of spring-loaded latch dogs.

7. The method as recited in claim 1, wherein latching comprises latching at a specific lateral wellbore of a plurality of lateral wellbores by matching specifically sized latch dogs with correspondingly sized latch openings.

8. The method as recited in claim 1, wherein providing comprises providing each spring-loaded latch dog in the form of a latch dog mounted on a beam spring.

9. The method as recited in claim 8, further comprising providing each latch dog with a downhole face angled to control a snap-in force and an uphole face angled to control a snap-out force.

10. The method as recited in claim 1, further comprising using the orienting member to grip the profile of the tubular structure during orienting.

11. A method, comprising:

providing spring members in a deflector tube by forming radial slots through a sidewall of the deflector tube to create beam spring members which flex in a radial direction with respect to the deflector tube;

mounting latch dogs on the spring members in an asymmetrical, circumferential pattern about the deflector tube;

locating a centralizer around the deflector tube;

arranging an orienting member at a position along the deflector tube to facilitate angular orientation of the deflector tube;

connecting an orienting member spring to the orienting member to allow the orienting member to be pushed radially inward; and moving the deflector tube into an alignment sleeve of an outer tubular structure so as to engage an orienting profile of the tubular member and rotatably adjust the deflector tube relative to the alignment sleeve so as to align the latch dogs with a respective configuration of latch openings within the alignment sleeve.

12. The method as recited in claim 11, further comprising routing the orienting member along a profile of the outer tubular structure by moving the deflector tube in a longitudinal direction with respect to the outer tubular structure.

13. The method as recited in claim 12, wherein moving the deflector tube comprises moving the deflector tube until the latch dogs latch into corresponding latch openings of an alignment sleeve mounted in the outer tubular structure.

14. The method as recited in claim 13, further comprising verifying latching between the desired number of latch dogs and the corresponding latch openings by measuring a pull force applied to the deflector tube without unlatching the latch dogs from the corresponding latch openings.

15. The method as recited in claim 14, further comprising locating a deflector slide in the deflector tube in cooperation with a deflector tube window.

16. The method as recited in claim 15, further comprising locating the alignment sleeve in a wellbore and conveying the deflector tube downhole into the wellbore until the latch dogs latch into the corresponding latch openings in a manner which orients the deflector tube window toward a selected lateral wellbore of a plurality of lateral wellbores.

17. A system, comprising:

a well tubular structure having a plurality of latch mechanisms, each latch mechanism comprising an alignment sleeve with a plurality of latch openings which have a unique configuration relative to the pluralities of latch openings of other latch mechanisms, each latch mechanism being associated with an alignment profile, the well tubular structure further having an orienting profile and a slot disposed in a sidewall of the well tubular structure extending from the orienting profile towards the alignment sleeve; and a deflector assembly having:

a deflector tube with a plurality of latch dog spring members;

a plurality of latch dogs mounted on the plurality of latch dog spring members; and an orienting member, the orienting member being positioned to engage the orienting profile and to rotatably adjust the deflector assembly with respect to the well tubular structure to facilitate latching of the plurality of latch dogs with a specific plurality of latch openings of a specific latch mechanism of the plurality of latch mechanisms as the orienting member is lowered within the slot.

18. The system as recited in claim 17, wherein the latch dogs are arranged in an asymmetrical, circumferential pattern about the deflector tube.

19. The system as recited in claim 17, wherein the orienting member is spring mounted on a beam spring formed in the deflector tube.

* * * * *